United States Patent [19]

Smith

[11] 3,973,173

[45] Aug. 3, 1976

[54] CURTAIN CONTROL SYSTEM FOR POULTRY HOUSES

[76] Inventor: Roman Oren Smith, Rte. No. 4 Box 508, Siler City, N.C. 27344

[22] Filed: Feb. 5, 1975

[21] Appl. No.: 547,175

[52] U.S. Cl. ..... 317/142 TD; 49/1; 119/21; 160/6; 160/9; 236/41

[51] Int. Cl.[2] ..... E05F 15/20

[58] Field of Search ..... 119/21; 160/1–9; 49/1–6; 317/151, 142 TD; 236/41

[56] References Cited

UNITED STATES PATENTS

| | | | |
|---|---|---|---|
| 3,042,001 | 7/1962 | Dubie et al. | 119/21 |
| 3,429,298 | 2/1969 | Thomason | 119/21 |
| 3,474,761 | 10/1969 | Thomason | 119/21 |
| 3,511,299 | 5/1970 | Newell et al. | 160/1 |
| 3,802,479 | 4/1974 | Newell et al. | 160/1 |

*Primary Examiner*—R. N. Envall, Jr.

[57] ABSTRACT

The side curtains of a poultry house are automatically opened upon a power failure in the electrical circuit of the ventilating system. An electrical monitoring circuit activated responsive to such power failure, releases a winch which normally maintains the curtains in a closed position, causing them to drop to an open position. The electrical monitoring system includes a time delay relay which is activated upon the power failure to release a normally latched mechanism. A latching cable is thus released, freeing the winch.

4 Claims, 3 Drawing Figures

CURTAIN CONTROL SYSTEM FOR POULTRY HOUSES

BACKGROUND OF THE INVENTION

For some years, poultry houses have been constructed with a relatively low roof which comes down to a point on either side of the center a few feet above the ground. Rather than solid, permanent side walls to connect the edge of the roof and the ground, one or more curtains are provided which may be selectively raised or lowered to control the amount of natural ventilation or to be used in conjunction with forced ventilation systems. Forced ventilation systems have been used with increasing frequency as a year round system. In winter months forced ventilation prevents moisture from forming inside which normally would occur and could drip from the roof causing the floor to become damp. In such systems it is conventional for the curtains to be raised from a lowered, open position to a closed or upper position with a winch and cable device.

The normal curtain positions when using forced ventilation (several electric fans which usually are powered by 220 volt power and are mounted in the side wall of the poultry houses such as normal exhaust fans) is with one curtain closed (up) and the other only open a few inches for air intake. Thus the inside of the house has an atmospheric pressure slightly less than outside. Some poultry houses with forced ventilation systems are operated with louvers as an air intake means. In such systems both curtains are normally closed (up). This forced ventilation system, as it is called by the poultry industry, is being used more and more to produce better quality poultry with less expense and less space per bird. The system requires several large fans for each house. Some of the electrical fans are operated on electrical timers and some are controlled by thermostats using an over-ride system with the timers and thermostats. Six fans each requiring a ¾ horse power motor would be normal for a house large enough to raise 15 to 20 thousand birds.

Such a system is quite satisfactory as far as ventilation and protection from the weather is concerned, unless a power failure occurs in the electrical circuit of the ventilating system. In such a case, without proper ventilation, the conditions within the poultry house make it extremely warm, and without proper air, the poultry can suffocate.

There has been developed at least one commercially available unit which, upon a power failure, activates a separate circuit containing a dry cell battery which heats a nichrome heater wire. A nylon cord extends from the curtain raising and holding apparatus and maintains the curtain in a closed position. The cord also passes closely adjacent the nichrome wire, so that as it heats, the cord burns through releasing the curtain raising apparatus causing the curtain to drop, thus providing natural ventilation.

There are several disadvantages to such a type of system. For example, the battery, when needed, may be in a poor condition and unable to deliver the power to perform its function. The user has no sure way of knowing if the system will perform. The dry cell being enclosed inside the unit is forgotten or neglected. If a storage battery is used it is costly and must be given regular attention to maintain it in a charged condition. Also, every time the power fails and the system is activated, the nylon cord, which is burned through, must be replaced. Furthermore, in dry conditions which frequently occur in poultry houses, there is generally substantial flammable material around, which could be dangerous with the nichrome heater wire which is heated to a temperature between 1000° to 1300°F.

SUMMARY OF THE INVENTION

The present invention, on the other hand, overcomes these disadvantages by first of all eliminating the nichrome heater wire and the battery. The present system is operated directly from the poultry house electrical system without any intermediate power source. Further, the latching or connecting cord is not burned through in the present system, merely released, so that the same cord may be used over and over again.

Toward this end, the system according to the present invention includes a latching or connecting cord which has one end fastened to the curtain raising assembly. The other end of the latching cord includes a connecting means for releasably connecting the cord to a latching mechanism, which in turn is operated responsive to a power failure. In the preferred form, an electrical monitoring circuit normally maintains the latch mechanism in a closed or "down" condition, however upon interruption of current in the poultry house power circuit activates a time delay relay which releases a solenoid activated, latch mechanism. The latch mechanism itself is a solenoid in which the plunger thereof normally holds the latching cord, but retracts responsive to a signal from the monitoring circuit, releasing the latching cord and freeing the winch device.

It is therefore an object of the present invention to provide an improved curtain release system for automatically opening the side curtains of a poultry house to provide natural ventilation in case of a failure in the electrical power circuit.

It is further an object of the present invention to provide a release system of the type described which is operated without an auxiliary power source.

Other objects and advantages of the invention will be readily appreciated by reference to the following detailed description when considered in connection with the accompanying drawings in which.

DESCRIPTION OF A PREFERRED EMBODIMENT

Figure 1:
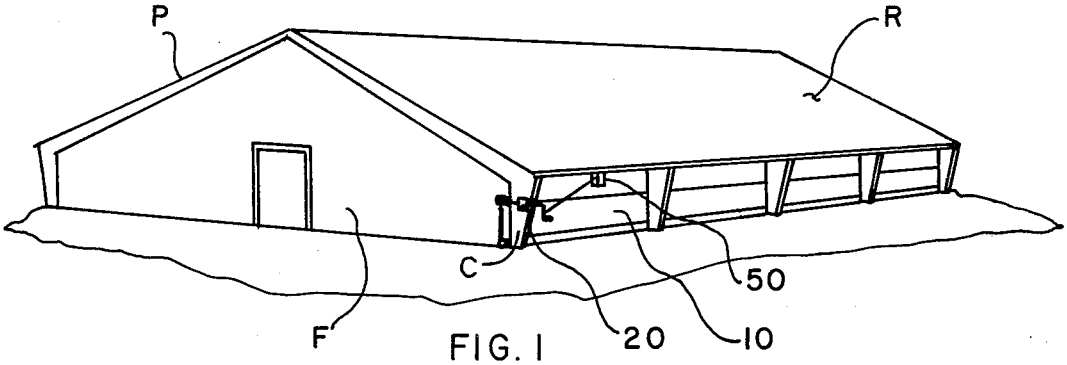
FIG. 1 is a perspective view of a poultry house illustrating the system according to the present invention mounted on the wall thereof.

Turning now to the drawings, and more particularly to FIG. 1, there is illustrated a typical poultry house P having a relatively low roof R and front and rear walls F. The present invention is particularly designed for poultry houses of the type which have no permanent side walls other than a frame construction C, and a curtain 10 which is selectively closed to define the side wall. As described hereinabove, the curtain may also be opened to allow air to circulate therethrough. The raising or lowering of curtain 10 is effected by means of curtain raising device 20, which preferably includes primarily a winch or windlass 22.

Figure 2:
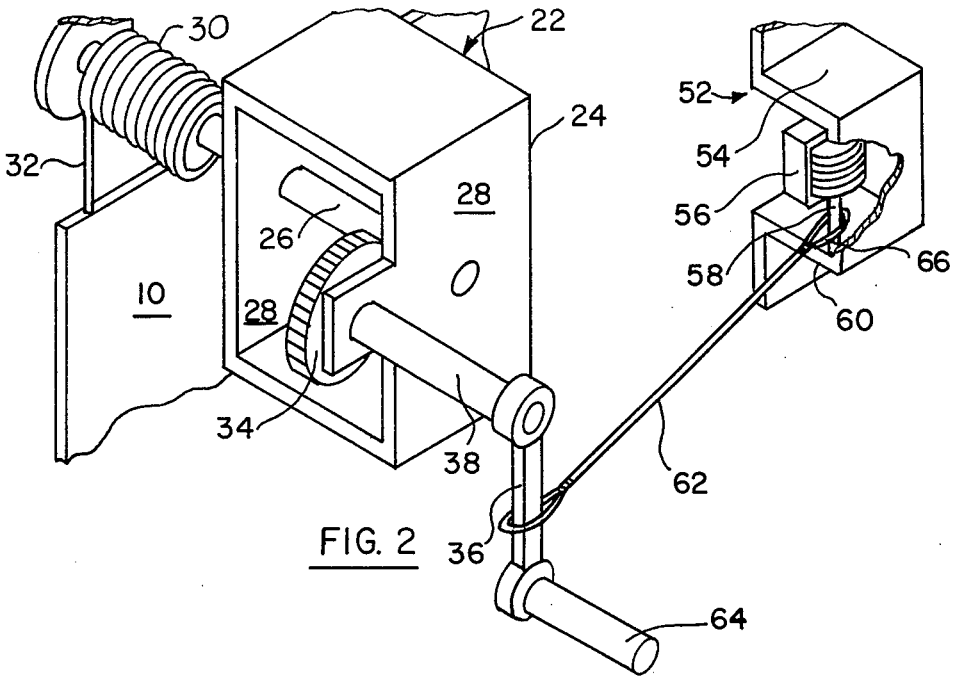
FIG. 2 is an enlarged perspective illustration of the apparatus according to the present invention illustrating the manner in which the curtains of the poultry house are controlled by the apparatus of the present invention.

Turning now to FIG. 2, there is a more detailed showing of the winch 22 which comprises a housing 24 suitably attached to the frame C of the poultry house P (FIG. 1). A shaft 26 is journaled between the side walls 28 of housing 24 and extends inwardly to a position preferably above curtain 10. A winding drum 30 is secured to the shaft 26 for rotation therewith at the inner end thereof and includes a lifting cable 32 attached to the upper end of curtain 10 for the lowering and raising thereof. To facilitate operation the winch assembly 22 is preferably geared up by means of a gear 34 which operatively engages the outer end of shaft 26 and is connected to an operating handle 36 by means of a shaft 38 journaled within the side wall 28 of housing 24 and extending outwardly thereof.

The latch mechanism 50 for releasing the winch assembly 22 to lower the curtain 10 upon a power failure is preferably a solenoid assembly 52 comprising a bracket 54 attached to the side framework C of the poultry house P. A solenoid 56 is secured within bracket 54 and includes a plunger 58 which in the normal closed position is extended downwardly to a point in contact with or substantially in contact with lower wall 60 of bracket 54. However, upon a power failure, the electrical circuitry to be described hereinafter causes plunger 58 to withdraw into the solenoid coil, thus leaving an open space between the end of plunger 58 and lower wall 60.

In order to provide the most reliable unlatching or release and in the preferred embodiment, it has been found that the plunger 58, in its extended position, should not extend outwardly from the solenoid more than a distance equal to the diameter of cord 62 plus one-sixteenth of an inch. By way of explanation FIG. 2 shows this plunger extension dimension and the distance between plunger 58 and lower wall 60 greatly exaggerated for the sake of clarity, when in actuality it is much reduced. Therefore the distance between the base of solenoid coil 56 and lower wall 60 should correspond to the preferred distance the plunger extends. The reason for limiting the plunger travel distance is to keep as high a torque as possible on the plunger when energized.

A latching cable or cord 62 having loop 64 at one end and loop 66 at the other end connects the handle 36 with plunger 58. The cable 62, when positioned between winch assembly 22 and latch mechanism 50, is taut, thus holding handle 36 and maintaining curtain 10 in an upper, closed position. As plunger 58 is withdrawn responsive to a power failure, it moves back through loop 66, whereupon the tension in latching cable 62 pulls the cable end free, freeing the handle 36, which unlocks winch assembly 22. The weight of curtain 10 then causes the curtain to fall unwinding cable 32 from drum 30. If desired, in cold weather, a stop (not shown) can be rigged to prevent the curtain from opening completely in the event of a power failure.

Figure 3:
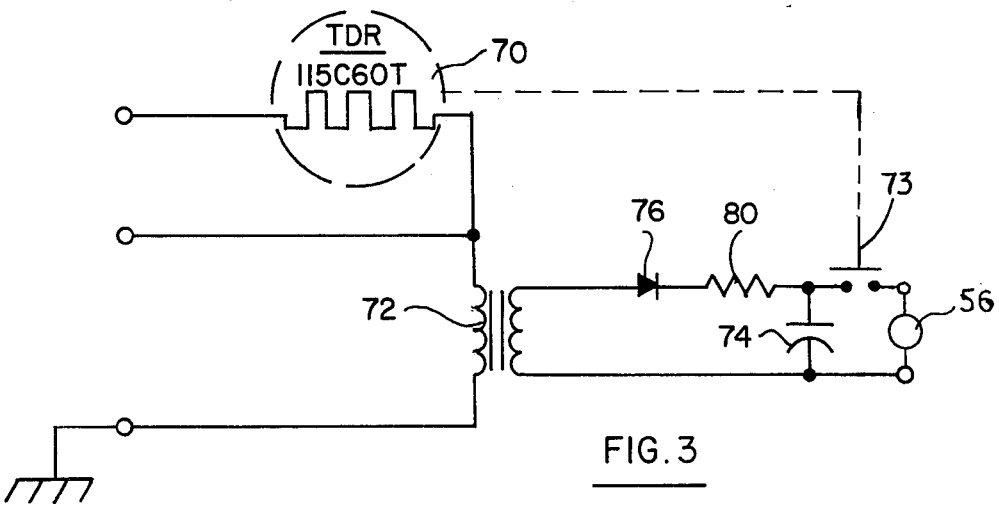
FIG. 3 is an electrical schematic of the present invention.

The electrical circuitry is illustrated in FIG. 3 and, for the purpose of this invention, normally monitors the AC power input supplying electricity to the poultry house exhaust fans. A time-delay relay 70 is connected in series with the primary winding of the transformer 72, in cases where the input voltage is 220 volts. (FIG. 3) Where 110 volts are utilized, the time-delay relay 70 and transformer 72 are connected in parallel (not shown). While AC power is being applied to this circuit, capacitor 74 is charged with DC voltage made available through rectification in diode 76. When the AC power input is interrupted, as by a power failure, the contacts of the time-delay relay are closed after a predetermined delay. The remaining charge of energy stored in capacitor 74 then surges into the solenoid 56, momentarily energizing the plunger 66 which retracts releasing the latching cable 62.

In operation with the AC power applied, the heater of the time-delay relay, which may preferably be of a type commonly designated by the manufacturer Amperite Co. Inc., Union City, N.J., as part no. 115C60T, 70 holds the contact 73 thereof open. During this time the diode 76 is rectifying the transformer voltage and charging the capacitor 74 to the peak of the secondary voltage of transformer 72. Should the AC input voltage fail, the contacts 73 of the time-delay relay 70 close after the preset delay time. This closed contact connects capacitor 74 with the solenoid 56. During the absence of AC power and before the time-delay relay contacts close, the charge on the capacitor 74 would discharge slightly by means of internal DC leakage. However after the preset delay of the time-delay relay, the energy remaining is sufficient to momentarily activate the plunger 58 of solenoid 56.

When the AC power is restored, the closed contacts 73 of the time-delay relay 70 prevent any buildup of charge on capacitor 74, while the resistor 80 limits the current to the solenoid thus preventing any further action or damage when the power is initially returned. After a second nominal delay of the time-delay relay when power is restored, contact 73 again open allowing the charge of capacitor 74 to build up again in preparation for resetting of the latching system.

It is therefore seen a new and improved curtain release system has been provided for poultry houses which is activated in response to a power failure, and which is not dependant on an auxiliary source of power such as a storage battery. Rather, a mechanical latch mechanism is operated by means of an electrical monitoring circuit to automatically release the curtain raising apparatus in case of a power failure.

Although the components of the system are described and illustrated in a specific arrangement, it should be recognized that various arrangements are possible as long as the operative relationship is maintained. Also, although a circuit with a single control circuit is shown, the concept may be expanded to operate a number of poultry houses from a single monitoring circuit.

It is apparent that various changes and modifications may be made to the apparatus without departing from the scope of the invention, which is set forth in the appended claims.

What is claimed is:

1. A curtain release device for poultry houses of the type having an electrically operated ventilating system and side wall curtains normally held in an upper or closed position by a cable connecting the curtains and a winch assembly, said device comprising:

a. An electrical monitoring means for completing an electrical circuit responsive to interruption of electrical current to said poultry house;

b. a normally closed latching means connected to said monitoring means, said latching means being moved to a release position responsive to the completion of said electrical circuit; and c. a connecting means having one end thereof attached to said winch assembly and the other end releasably connected to said latching means, said connecting means normally holding said winch assembly with said curtains in a closed position, but being released upon movement of said latching means to said release position to thereby release said winch assembly, whereby said curtain is released upon interruption of electrical current to said poultry house.

2. The curtain release device according to claim 1 wherein said connecting means comprises a latching cable having a loop at either end, one of said loops being connected to the crank handle of said winch assembly and the other loop being connected to said latching means, the length of said cable being such that when said curtain is in an upper, closed position and the latching means is in a closed position, said cable is taut, whereby upon release of said latching means, the tension in said cable pulls the loop away from said latching means.

3. The curtain release device according to claim 2 wherein said latching means comprises a bracket mounted to said poultry house adjacent said winch assembly and a solenoid secured to said bracket, said solenoid including a plunger operated in response to said monitoring means to move from a normally extended position to a fully retracted position upon interruption of electrical current to said poultry house.

4. The curtain release device according to claim 3 wherein said monitoring means includes a time-delay relay having a set of contacts which are normally maintained open by the presence of AC power, said contacts being closed upon passage of a preselected time interval after an interruption of electrical current to said poultry house, a capacitor receiving current during normal operation to build up a charge, and upon interruption of electrical current discharging its stored-up energy through said closed contacts to said solenoid for operation thereof.

* * * * *